US010724691B2

(12) United States Patent
Ion

(10) Patent No.: US 10,724,691 B2
(45) Date of Patent: Jul. 28, 2020

(54) LIGHTBULB AND BULB CAP THEREFOR

(71) Applicant: CORE LIGHTING LIMITED, Gloucestershire (GB)

(72) Inventor: Phil Ion, Gloucestershire (GB)

(73) Assignee: Core Lighting Limited, Gloucestershire (GB)

( * ) Notice: Subject to any disclaimer, the term of this patent is extended or adjusted under 35 U.S.C. 154(b) by 0 days.

(21) Appl. No.: 16/319,378

(22) PCT Filed: Jul. 13, 2017

(86) PCT No.: PCT/GB2017/052071
§ 371 (c)(1),
(2) Date: Jan. 21, 2019

(87) PCT Pub. No.: WO2018/015720
PCT Pub. Date: Jan. 25, 2018

(65) Prior Publication Data

US 2019/0331304 A1 Oct. 31, 2019

(30) Foreign Application Priority Data

Jul. 21, 2016 (GB) ..... 1612649.2

(51) Int. Cl.

| | |
|---|---|
| ***F21K 9/235*** | (2016.01) |
| ***F21S 9/02*** | (2006.01) |
| ***F21V 23/04*** | (2006.01) |
| ***H01R 33/22*** | (2006.01) |
| ***H01R 33/46*** | (2006.01) |
| ***H01R 33/90*** | (2006.01) |
| ***F21Y 115/10*** | (2016.01) |

(52) U.S. Cl.
CPC ..... *F21K 9/235* (2016.08); *F21S 9/02* (2013.01); *F21V 23/0435* (2013.01); *H01R 33/22* (2013.01); *H01R 33/46* (2013.01); *H01R 33/90* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 1,640,434 | A | 8/1927 | Weston | |
| 5,989,070 | A | 11/1999 | Al-Turki | |
| 9,006,963 | B1 | 4/2015 | Al-Saqabi | |
| 9,534,773 | B1 * | 1/2017 | Turudic | F21V 23/005 |
| 2003/0228801 | A1 | 12/2003 | Holzer | |
| 2006/0170323 | A1 | 8/2006 | Hirsch et al. | |
| 2012/0286644 | A1 | 11/2012 | Chin | |

(Continued)

FOREIGN PATENT DOCUMENTS

| | | | |
|---|---|---|---|
| FR | 2811145 | A1 | 1/2002 |
| WO | WO2009/112391 | A1 | 9/2009 |

*Primary Examiner* — Britt D Hanley
(74) *Attorney, Agent, or Firm* — Standley Law Group LLP; Melissa A. Rogers McCurdy; Stephen L. Grant

(57) ABSTRACT

A lightbulb comprising a bulb portion (10) in which is housed an illuminating component configured to selectively emit visible light, the lightbulb having a cap portion (16) configured to mount the lightbulb in a light fitting or lamp holder, the cap portion incorporating a adaptor element configured to selectively alter the configuration of the cap portion between a screw fitting and a bayonet fitting.

9 Claims, 6 Drawing Sheets

(56) References Cited

U.S. PATENT DOCUMENTS

| | | | | |
|---|---|---|---|---|
| 2014/0073159 | A1 | 3/2014 | Chin | |
| 2014/0265905 | A1* | 9/2014 | Ray | F21S 9/02 315/210 |

* cited by examiner

LIGHTBULB AND BULB CAP THEREFOR

This invention relates generally to a lightbulb for insertion into a socket or holder in, for example, a table lamp or ceiling light fitting, and that can be selectively switched on to provide illumination within a room or area. In one exemplary embodiment, the invention relates to a battery powered LED lightbulb for insertion in such a socket or holder for this purpose, but the present invention is not necessarily limited in this regard. This invention also relates to a bulb cap for a lightbulb.

Lightbulbs are well known and have been in widespread use for over a century. In its original form, a lightbulb comprises a glass bulb filled with an inert gas such as argon, having a fitting or 'cap' at its base to enable it to be mounted in a lamp holder or light fitting for use. Within the bulb, metal contacts, having a thin metal filament therebetween, are mounted and electrically connected to the cap at the base of the bulb, which acts as an electrical contact. In use, the lightbulb is secured within the light fitting, for electrical contact therewith and, when the lamp or light is switched on, electricity flows from the source to the filament, via the bulb cap and contacts, and causes the filament to emit visible light.

Battery powered LED lightbulbs are also known, which have a similar outward appearance to conventional lightbulbs of the type described above, in that they comprise a transparent/translucent bulb portion having a fitting or cap at the base for enabling the bulb to be mounted for use within a lamp holder or light fitting. However, in this case, within the bulb portion there is provided an LED electrically connected, via an internal switch, to a battery. When the switch is closed (for example, by remote wireless operation), the circuit is completed and power from the battery causes the Led to emit visible light. Thus, in this case, the cap at the base of the bulb does not need to act as an electrical contact (indeed, in many cases, it is safer if it is not electrically conductive) and, as such, is often formed of an insulative material such as a hard plastic, nylon or the like.

In general, the bulb holder provided on substantially all commercially available lamps and light fittings is one of a number of standard types/sizes. Thus, for example, there are at least two widely used screw type fittings, wherein the bulb holder, which is generally cylindrical, has a screw threaded profile around its inner walls and the corresponding bulb cap, which is also generally cylindrical, has a screw threaded profile around its outer wall. The bulb is mounted in the holder by aligning the cap with the holder and inserting the distal end thereof into the open end of the holder, and then screwing the cap into the holder such that the corresponding threaded surfaces engage and the cap is thus secured within the holder to mount the bulb thereon.

Two sizes of screw fitting are most commonly used in the United Kingdom, namely E27 (large) and E14 (small).

Another commonly used bulb fitting is known as a bayonet fitting, wherein the generally cylindrical holder has matching L-shaped slots extending from its upper edge, and the cylindrical bulb cap has a pair of radial pins extending therefrom. In use, the pins on the bulb cap are aligned with the slots in the holder and the cap is then pushed into the holder. Once the pins reach the bottom of the slots, the bulb (and cap) is rotated so that the pins slide along the horizontal arm of the 'L' until the pins reach the respective 'serifs'. A spring then pushes the bulb cap up into the respective 'serifs' to keep the pins locked in place. A bayonet cap size commonly used in the United Kingdom is known as B22.

Thus, whenever a user wishes to use a particular light or lamp fitting, they must ensure that they have a lightbulb that has the correct cap fitting and size, as only a bulb having the corresponding cap fitting/size will fit into any specific holder. This can be inconvenient and can result in unnecessary additional expenditure in domestic environments. However, in some circumstances, such as within the events industry, where time may of the essence, various types of lighting are required to be used to fulfil a specific lighting plan, and there is little margin for error in relation to the types and number of bulbs available for use, having the wrong bulb fitting for a specific element of a lighting plan can be catastrophic.

It is an object of aspects of the present invention to address at least some of these issues and, in accordance with a first aspect of the present invention, there is provided a lightbulb comprising a bulb portion in which is housed an illuminating component configured to selectively emit visible light, the lightbulb having a cap portion configured to mount the lightbulb in a light fitting or lamp holder, the cap portion incorporating a adaptor element configured to selectively alter the configuration of the cap portion between a screw fitting and a bayonet fitting.

In an exemplary embodiment, the cap portion may comprise a first screw threaded mount and a collar having a pair of radially outwardly extending pins, said collar being mounted on said cap portion for selective longitudinal retraction and extension relative thereto. The adaptor element may be configured to selectively alter the configuration of said cap portion between first and second screw fittings and a bayonet fitting. In an exemplary embodiment, the cap portion may comprise a first screw threaded mount, a second screw threaded mount and a collar having a pair of radially outwardly extending pins, said collar being mounted on said cap portion for selective longitudinal retraction and extension relative thereto. The second screw threaded mount may be mounted on said cap portion for selective longitudinal extension and retraction relative thereto. The collar may be concentrically mounted on said second screw threaded mount for selective longitudinal movement relative thereto along at least a portion of its length. In this case, the collar may have a pair of inwardly extending radial pins and said second mount has a pair of longitudinal channels configured to receive respective said inwardly extending radial pins when said collar is mounted on said second mount, so as to enable sliding movement of said collar along a length of said second mount defined by said channels.

In one exemplary embodiment, the second mount may be of a smaller diameter than that of the first mount, the first mount may be generally tubular having a distal open end, and the second mount may be mounted concentric to said first mount, within said open end, for longitudinal movement relative thereto so as to enable the second mount to be selectively extended from and retracted into said first mount.

In one specific exemplary embodiment, the first screw threaded mount may have a diameter and screw thread configuration conforming to the E27 standard, the collar may have a diameter and configuration conforming to the B22 standard, and/or the second screw threaded mount may have a diameter and screw thread configuration conforming to the E14 standard.

The illuminating component may, for example, comprise one or more LEDs. In this case, the lightbulb may comprise a bulb portion, a housing including one or more batteries, and a top cap. The one or more LEDs may be selectively wirelessly operable, in which case, an antenna may be mounted in said top cap.

In accordance with another aspect of the present invention, there is provided a bulb cap for a lightbulb, the bulb cap being affixed to or otherwise provided on a lightbulb, and being configured to mount the lightbulb in a light fitting or lamp holder, the bulb cap incorporating a adaptor element configured to selectively alter the configuration of the bulb cap between a screw fitting and a bayonet fitting.

The present invention extends to a battery-powered LED lightbulb including a bulb cap substantially as described above.

These and other aspects of the present invention will be apparent from the following specific description, in which embodiments of the invention are described in detail, by way of examples only, and with reference to the accompanying drawings, in which.

Figure 1:
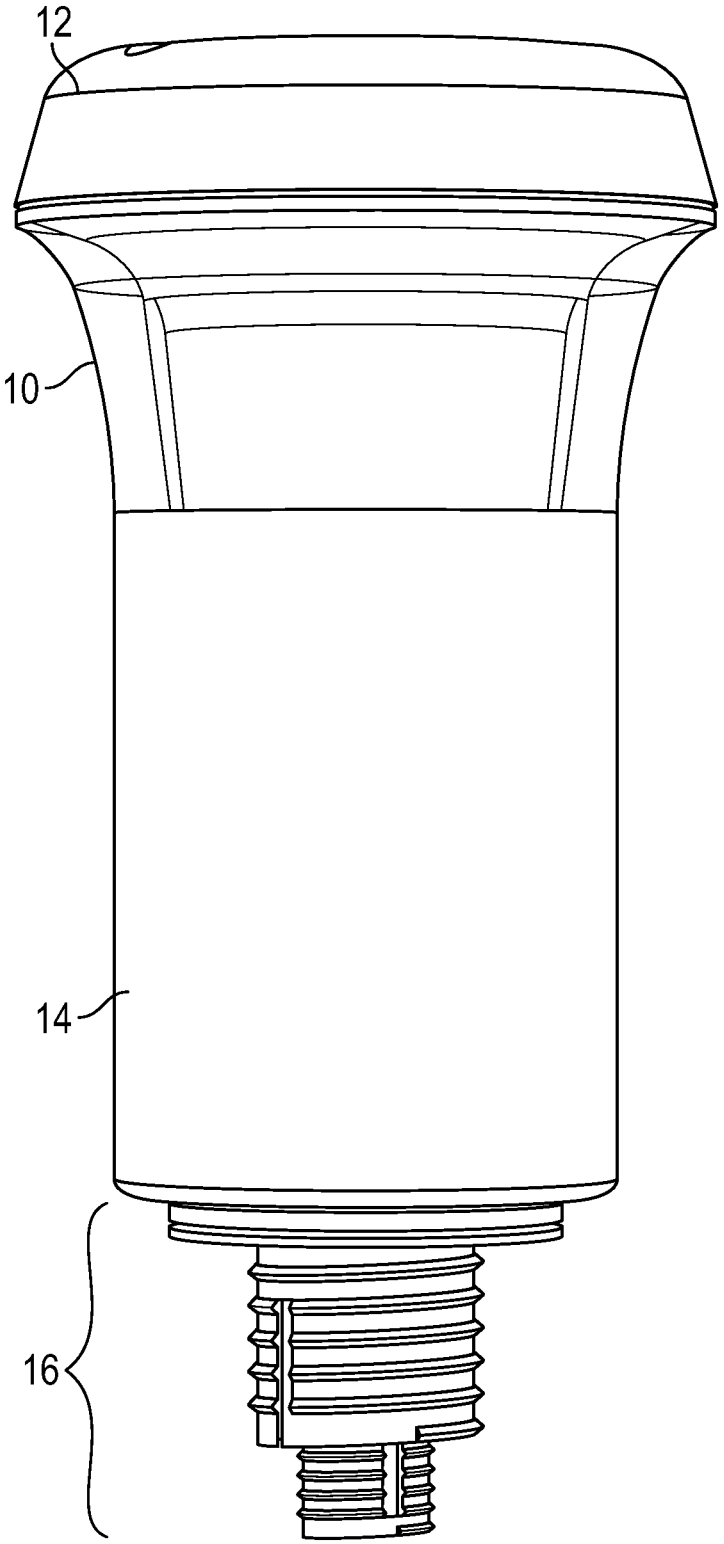
FIG. 1 is a schematic perspective view of a battery powered LED lightbulb according to an exemplary embodiment of the present invention.

Referring to FIG. 1 of the drawings, a battery powered LED lightbulb according to a first exemplary embodiment of the present invention comprises a bulb portion 10, a top cap 12 covering a first end of the bulb portion 10, a housing 14 at the opposing end of the bulb portion 10 and a bulb cap portion 16. For the purposes of the following description, the end of the lightbulb defined by the top cap 12 will be referred to hereinafter as the upper end of the lightbulb, and the opposing end of the lightbulb, defined by the bulb cap 16, will be referred to hereinafter as the lower end of the lightbulb. However, it is to be understood that, whereas in some cases, the bulb cap will be directed downward within a lamp holder, when oriented for use, in other cases, the bulb cap will be directed upwardly within a ceiling light fitting when oriented for use, and the present invention is not necessarily intended to be limited with regard to its orientation when in use (this will depend entirely on the nature of the lamp holder or light fitting in which it is mounted).

Figure 2A:
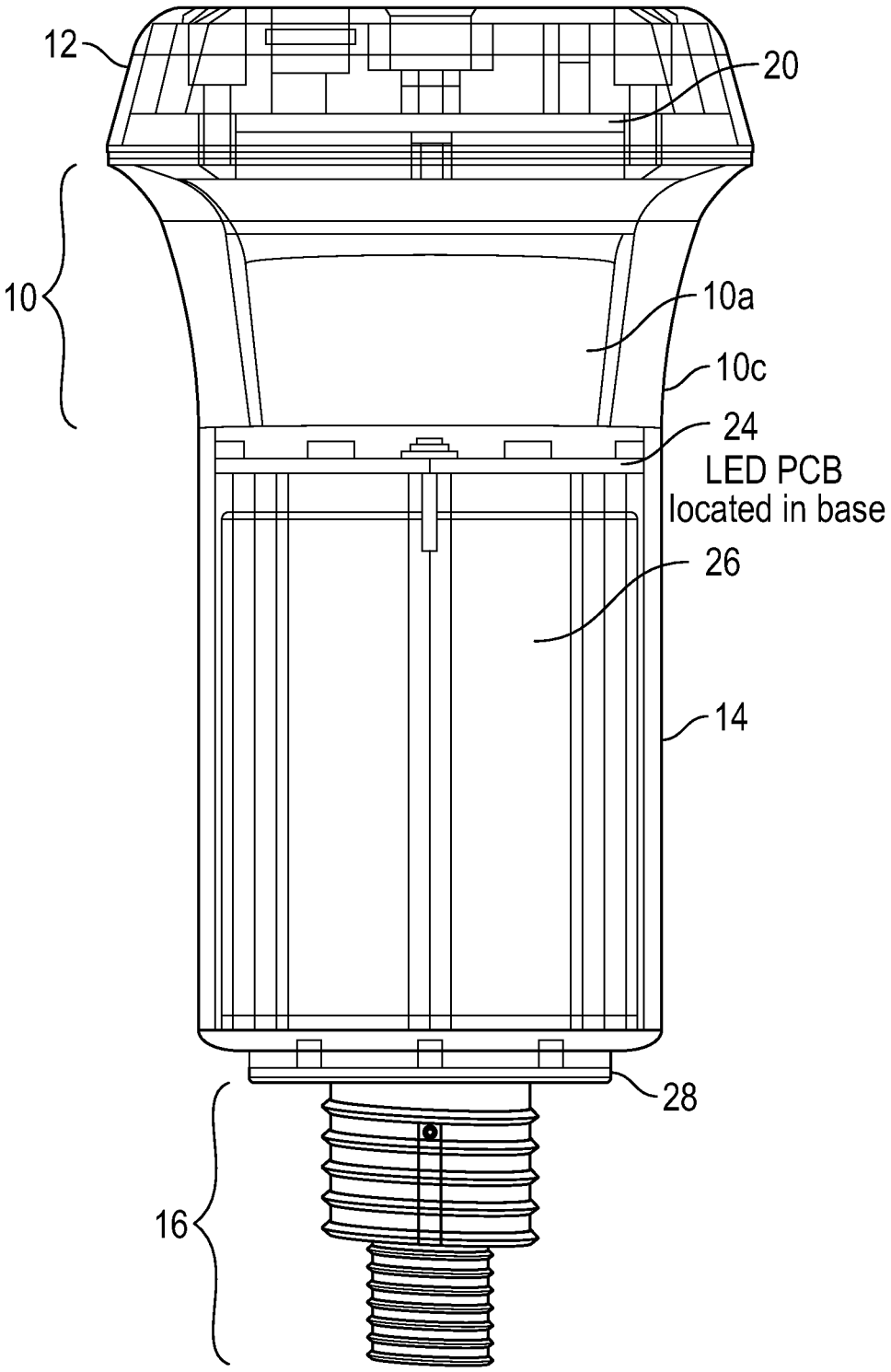
FIG. 2A is a schematic front view of a lightbulb according to an exemplary embodiment of the present invention.
Figure 2B:
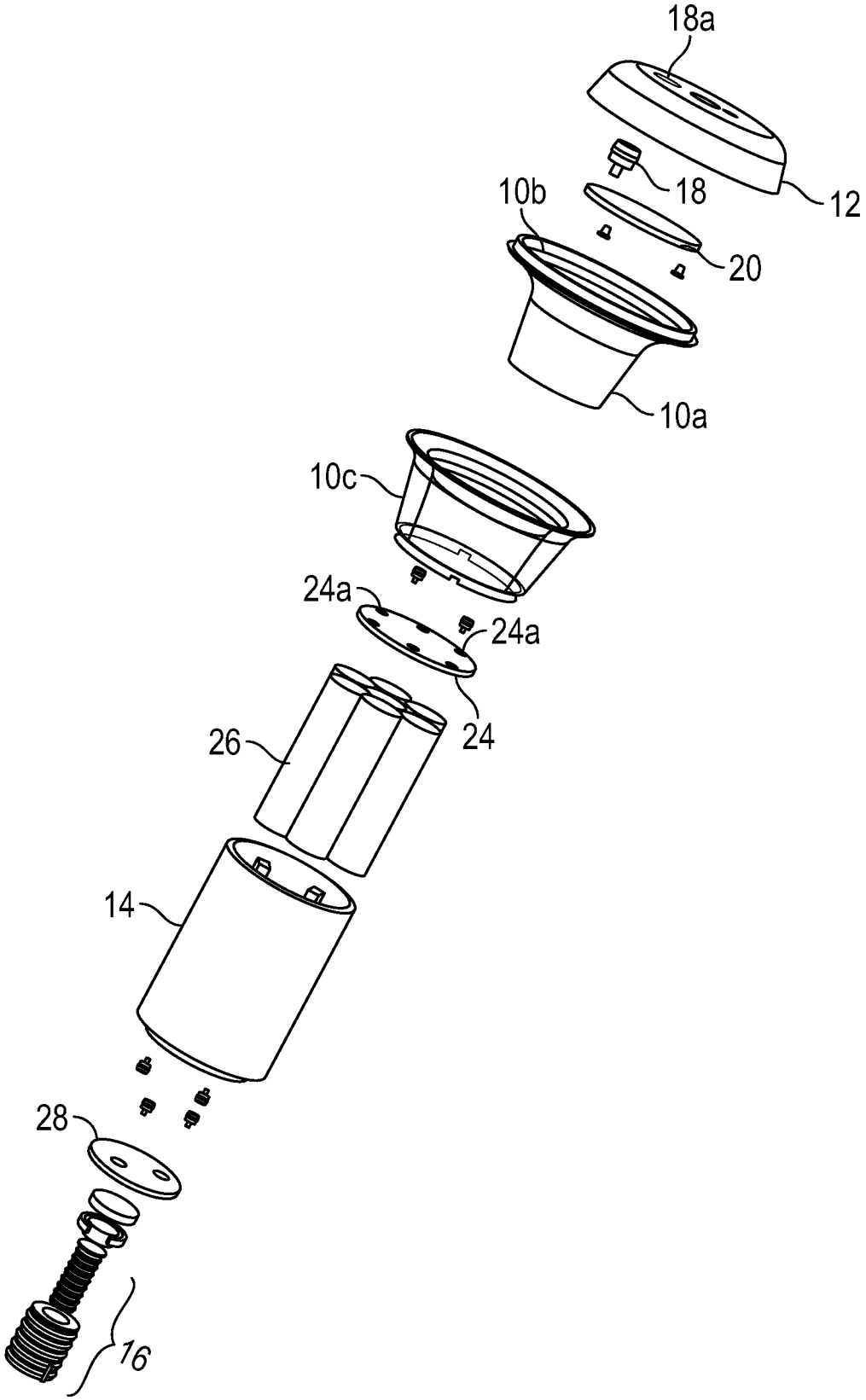
FIG. 2B is a schematic exploded view of the lightbulb of FIG. 2A.

Referring now to FIGS. 2A and 2B of the drawings, the various elements and components of the lightbulb of FIG. 1 can be seen in more detail. Thus, the lightbulb comprises a top cap 12 which fits over the open end of the bulb portion 10. The bulb portion 10 comprises a first receptacle 10*a* defining a circumferential lip 10*b* at one end, which sits substantially concentrically within a second, transparent/translucent receptacle 10*c*. An antenna 18 is mounted in an aperture 18*a* in the top cap 12 and an associated PCB 20 rests on the circumferential lip 10*b* defined at one end of the first receptacle 10*a*. Thus, when assembled, the first receptacle 10*a* sits within the second receptacle 10*c*, the antenna PCB 20 rests on the circumferential lip 10*b* defined at the 'upper' end of the first receptacle 10*a* and the top cap 12, including the antenna 18, is affixed over the opening defined at the 'upper' end of the second receptacle 10*c* so as to cover the 'upper' end of the bulb portion 10.

A cylindrical housing 14 is concentrically mounted at the 'lower' open end of the second receptacle 10*c*, the housing 14 being formed of a heat conductive material. A second PCB 24, hereinafter referred to as the LED PCB, is screwed directly on the housing 14, over the open 'upper' end thereof (adjacent the bulb portion 10) such that the housing 14 provides heat sinking therefor. A plurality of LEDs 24*a* is provided adjacent the circumferential edge of the LED PCB 24, in substantially equi-angularly spaced-apart configuration. It is, for example, possible to use a cluster of (or multiple) white LEDs, but a number of different coloured LEDs (in the same bulb) could be used instead, including but not limited to red, green, blue, amber, cyan, UV and/or white, and the present invention is not intended to be limited in this regard.

A battery pack 26 is housed within the housing 14 and electrically connected to the LED PCB 24, and a heat conductive plate 28 is screwed over the open 'lower' end of the housing 14 to close the assembly.

In use, a remote control unit can be used to switch the LEDs on and off (via the antenna 18).

Figure 3A:
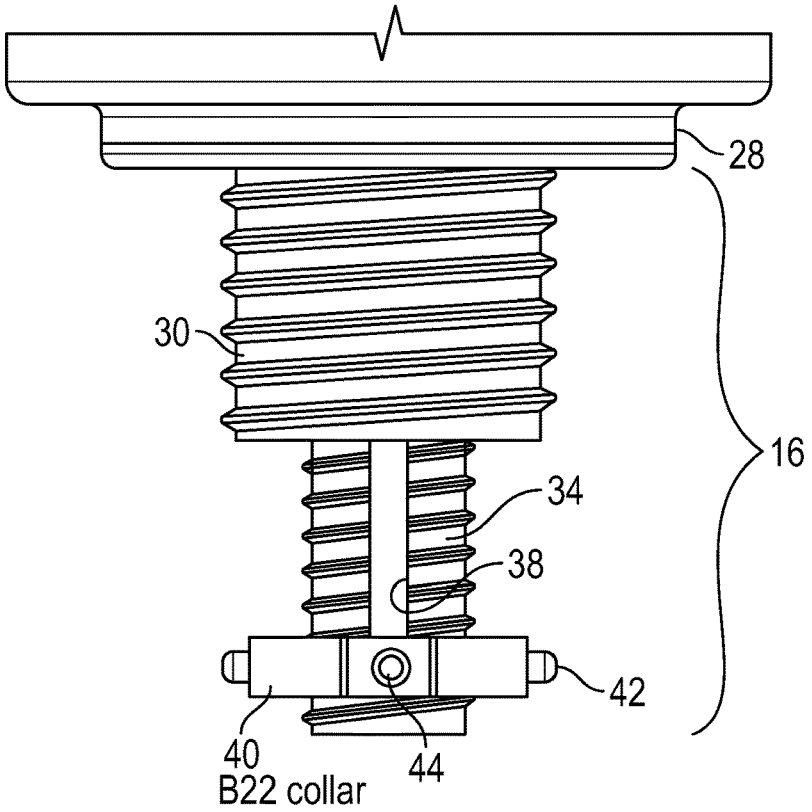
FIGS. 3A, 3B and 3C are schematic front, perspective and front transparent views respectively of a bulb cap according to an exemplary embodiment of the invention, configured for use as a bayonet fitting.
Figure 3B:
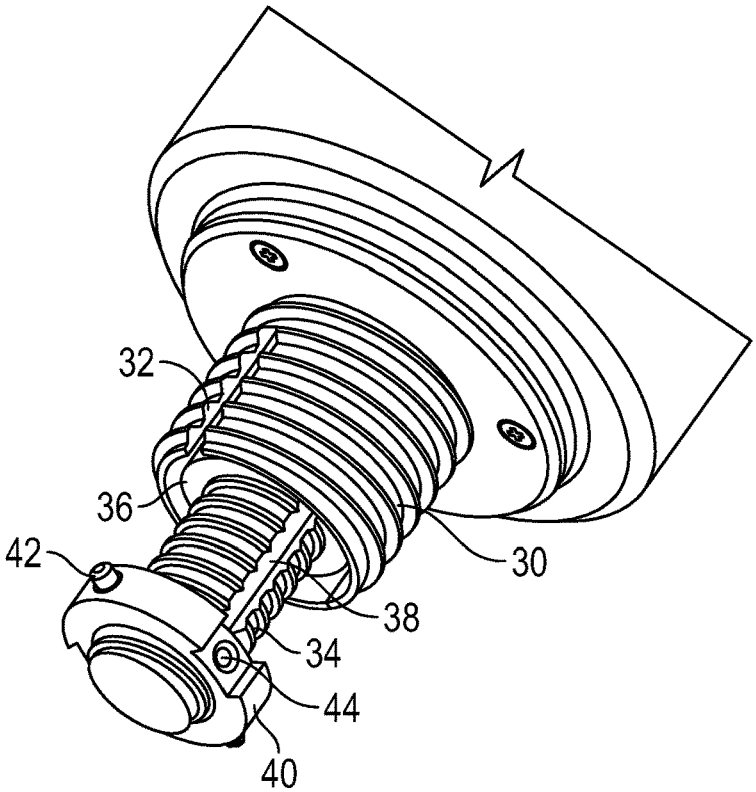
Figure 3C:
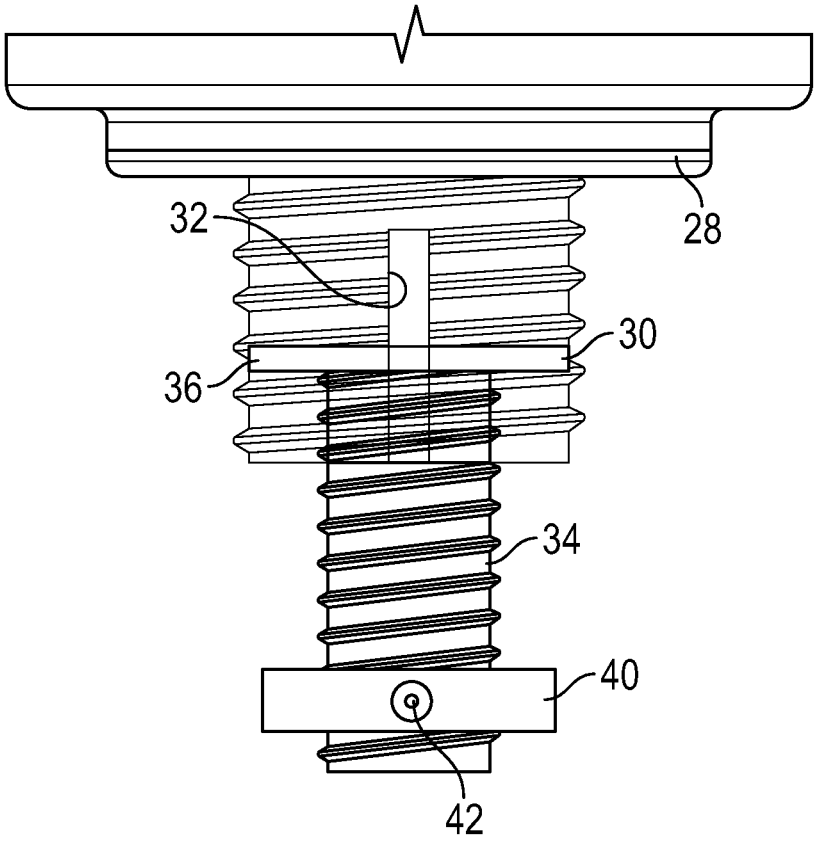

Referring now to FIGS. 3A to 3C of the drawings, the bulb cap portion 16 will now be described in more detail. In this exemplary embodiment of the invention, in which the lightbulb is a battery powered LED lightbulb, the bulb cap portion 16 is not required to act as an electrical contact, but simply a means of mounting the lightbulb within one of a number of standard lamp holders. Thus, it may be formed of an insulative material, such as hard plastic, ceramic, nylon or the like. However, in other exemplary embodiments, the bulb cap portion 16 may be formed of electrically conductive material as required by a specific application, and the present invention is not necessarily intended to be limited in this regard.

Thus, and as illustrated in FIGS. 3A to 3C of the drawings, the bulb cap portion 16 is mounted or otherwise affixed to the plate 28 over the 'lower' end of the housing 14, such that it extends longitudinally 'downwardly' therefrom. The bulb cap portion 16, in this exemplary embodiment, comprises a first cylindrical mount 30 having a diameter and screw threaded outer profile that conforms to a first screw fitting standard, such as the above-mentioned E27. The first mount 30 has a pair of diametrically opposing slots 32 extending longitudinally along a substantial portion of the length of its outer wall from the distal peripheral edge thereof.

The bulb cap portion further comprises a second cylindrical mount 34, of smaller diameter than that of the first mount 30, concentrically mounted within the first mount 30 so as to extend from the open distal end thereof. The proximal end of the second mount 34 (located within the first mount 30) includes a concentric plunger portion 36, of larger diameter than that of the second mount 34, that engages in a friction fit with the inner side walls of the first mount 30 so that the second mount 34 can be slidably extended from and retracted into the first mount 30. The distal end of the first mount 30 is tapered to define an opening of diameter slightly smaller than the diameter of the rest of the first mount 30 (and the plunger portion 36) such that the second mount 34 is prevented from being completely pulled out of the first mount 30. A pair of diametrically opposing, elongate channels 38 is provided along a portion of the length of the second mount 34.

A collar 40 is mounted concentrically over the outside of the second mount 34 and has a diameter sufficient to enable it to slide back and forth along the second mount 34. The collar 40 has a first pair of diametrically opposing radial pins 42 extending outwardly from an outer circumferential wall thereof. The collar 40 has a second pair of diametrically opposing pins 44 extending radially inwardly from an inner circumferential wall thereof. The second pair of pins 44 extends into respective channels 38 in the second mount 34 such that the collar 40 is held in position thereon as it slides back and forth along the cylindrical mount 34. The channels 38 in the second mount 34 stop short of the distal end so the collar 40 cannot be completely pulled off the end of the second mount 34. The outwardly extending radial pins 42 provided on the collar 40 lie on a diameter thereof that is substantially orthogonal to the diameter on which the inwardly extending radial pins 44 lie.

As stated above, the diameter and screw thread configuration of the first mount 30 conforms to a first standard bulb cap screw fitting, such as E27. The diameter and screw thread configuration of the second mount 34 conforms to a second standard bulb cap screw fitting, such as E14. The collar 40 (including the radial pins 42) is of a diameter and configuration that conforms to a first bulb cap bayonet fitting such as B22. The bulb cap portion 16 is thus configured to selectively operate as an E27 bulb cap, an E14 bulb cap or a B22 bulb cap, depending on user requirements and the lamp holder or light fitting required to be used.

In FIGS. 3A to 3C of the drawings, the bulb cap portion 16 is configured to be used as a B22 bayonet fitting, with the second mount 34 fully extended relative to the first mount 30 and the collar 40 located at the 'lowest' end of the channels 38 in the second mount 34. In this configuration, the bulb cap portion 16 can be used to mount the lightbulb in a standard B22 bayonet type lamp holder or light fitting in the manner described above.

Figure 4A:
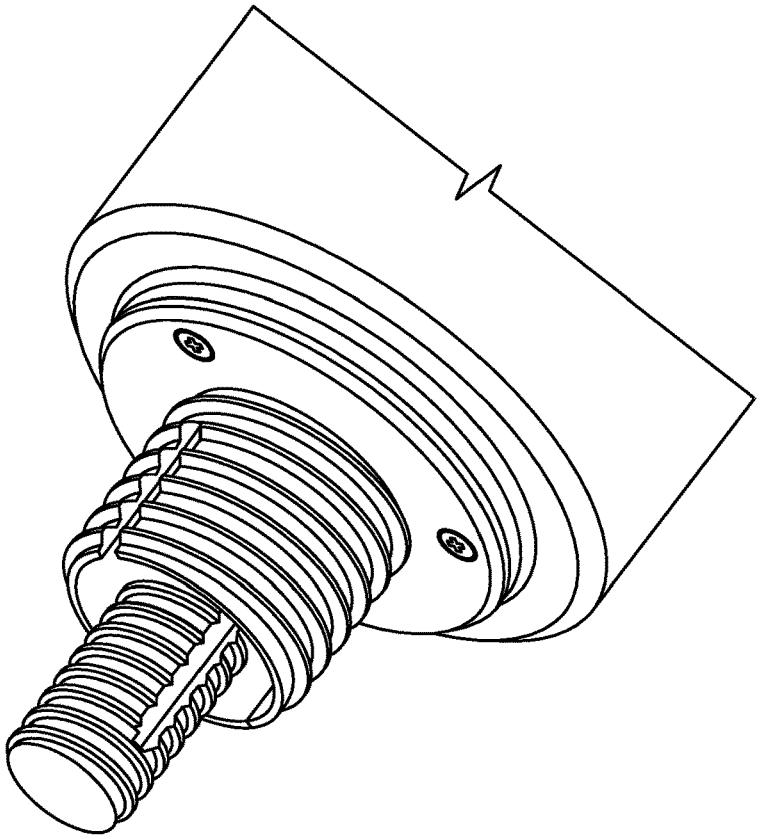
FIG. 4A is a schematic perspective view of the bulb cap of FIGS. 3A to 3C, configured for use as a first screw fitting.

In order to convert the bulb cap portion 16 to an E14 screw fitting, a user slides the collar 40 'upwardly' along the second mount 34 and into the first mount 30 (where the outwardly extending radial pins 42 are accommodated within the slots 32 therein). The collar 40 can thus be pushed completely into the first mount (so as to be surrounded by the cylindrical side walls of the first mount 30), as shown in FIG. 4A of the drawings. In this configuration, the bulb cap portion 16 can be used to mount the lightbulb in a standard E14 screw fitting type lamp holder or light fitting (via the second mount 34).

Figure 4B:
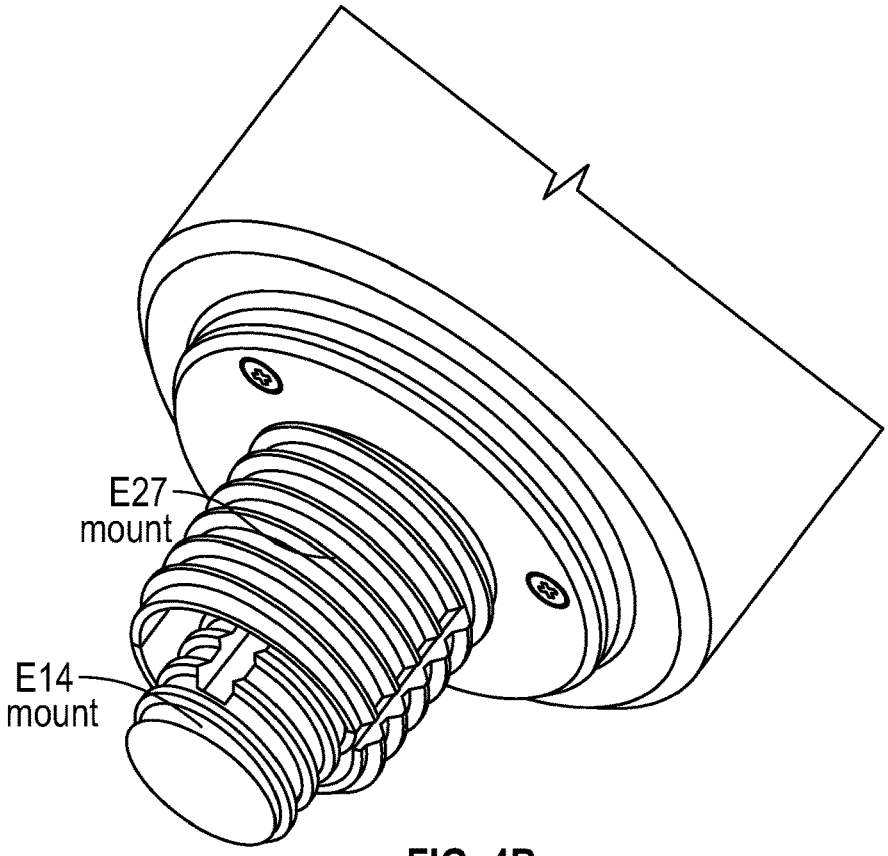
FIG. 4B is a schematic perspective view of the bulb cap of FIGS. 3A to 3C configured for use as a second screw fitting.

In order to convert the bulb cap portion 16 to an E27 screw fitting, a user pushes or retracts the second mount 34 'upwardly' into the first mount 30, until the outwardly extending radial pins 42 on the collar 40 (which is located at the 'top' of the second mount 34) hit the ends of the slots 32 in the first mount 30, as shown in FIG. 4B of the drawings. In this configuration, the bulb cap portion 16 can be used to mount the lightbulb in a standard E27 screw fitting type lamp holder or light fitting (via the first mount 30).

If, from the configuration shown in FIG. 4B (i.e. E27 screw fitting configuration), a user wishes to convert the bulb cap portion 16 to one of the other configurations, the reverse process can be applied. Thus, to convert from E27 to E14, the user pulls the second mount 34 outwardly relative to the first mount 30 until it is fully extended and cannot be extended further. To convert from E14 to B22, the user simply pulls the collar 40 'down' along the second mount 34, until it cannot travel any further.

It will be appreciated by a person skilled in the art, from the foregoing description, that modifications and variations can be made to the described embodiments, without departing from the scope of the invention as defined by the appended claims.

The invention claimed is:

1. A lightbulb comprising a bulb portion in which is housed an illuminating component, said illuminating component emitting light when powered;

wherein the lightbulb has having a cap portion configured to mount the lightbulb in a light fitting or lamp holder;

wherein the bulb cap portion comprises first and second cylindrical mounts, the second cylindrical mount being concentrically mounted within the first cylindrical mount;

wherein the second cylindrical mount has a smaller diameter than that of the first cylindrical mount;

wherein each of the first and the second cylindrical mounts is provided with a screw thread, the screw thread of the first mount having a different diameter than that of the screw thread of the second mount;

wherein said cap portion further comprises a collar around the second cylindrical mount, said collar having inwardly extending radial pins which slide into and along channels of the second cylindrical mount, so that said collar is mounted on said cap portion for selective longitudinal retraction and extension relative thereto; and wherein the collar further has a pair of radially outwardly extending pins for a bayonet fitting.

2. The lightbulb according to claim 1, wherein said second screw threaded mount is mounted on said cap portion for selective longitudinal extension and retraction relative thereto.

3. The lightbulb according to claim 1, wherein the first mount is generally tubular having a distal open end, and the second mount is mounted within said open end, for longitudinal movement relative thereto so as to enable the second mount to be selectively extended from and retracted into said first mount.

4. The lightbulb according to claim 1, wherein said first screw threaded mount has a diameter and screw thread configuration conforming to the E27 standard.

5. The lightbulb according to claim 1, wherein said collar has a diameter and configuration conforming to the B22 standard.

6. The lightbulb according to claim 1, wherein said second screw threaded mount has a diameter and screw thread configuration conforming to the E14 standard.

7. The lightbulb according to claim 1, wherein said illuminating component comprises one or more LEDs.

8. The lightbulb according to claim 7, comprising a bulb portion, a housing including one or more batteries, and a top cap.

9. The lightbulb according to claim 8, wherein said one or more LEDs are selectively wirelessly operable, and wherein an antenna is mounted in said top cap.

* * * * *